US012172265B2

(12) United States Patent
Rubens et al.

(10) Patent No.: US 12,172,265 B2
(45) Date of Patent: Dec. 24, 2024

(54) MANDREL ASSEMBLY FOR USE WITH A ROTARY TOOL

(71) Applicant: Robert Bosch GmbH, Stuttgart (DE)

(72) Inventors: Jeremy Rubens, Palatine, IL (US); Caitlyn Miklasz, Chicago, IL (US); Alexander Hills, Belvidere, IL (US)

( * ) Notice: Subject to any disclaimer, the term of this patent is extended or adjusted under 35 U.S.C. 154(b) by 247 days.

(21) Appl. No.: 17/895,637

(22) Filed: Aug. 25, 2022

(65) Prior Publication Data

US 2024/0066662 A1 Feb. 29, 2024

(51) Int. Cl.
*B24B 45/00* (2006.01)
*B24D 5/16* (2006.01)

(52) U.S. Cl.
CPC ..... *B24B 45/006* (2013.01); *B24D 5/16* (2013.01)

(58) Field of Classification Search
CPC ..... B25F 3/00; B24B 45/006; B24B 23/022; B24B 45/00; B24D 5/16; B24D 13/20; B24D 7/16
USPC ..... 279/143, 904; 29/243; 451/911, 344; 83/665
See application file for complete search history.

(56) References Cited

U.S. PATENT DOCUMENTS 1,941,840 A 1/1934 Kelsey
4,661,009 A 4/1987 Tripp
4,730,952 A 3/1988 Wiley
6,612,039 B2 9/2003 Kakiuchi et al.
7,367,874 B2 * 5/2008 Schleicher ..... A61C 1/14 451/911
7,387,563 B2 6/2008 Allemann et al.
7,484,736 B2 2/2009 Allemann et al.
7,614,940 B2 11/2009 Jerome et al.
8,096,855 B2 1/2012 Jerome et al.
8,641,049 B2 2/2014 Marini et al.
10,144,110 B2 12/2018 Furusawa et al.
11,173,592 B2 11/2021 Furusawa et al.
2019/0202027 A1 7/2019 Fellmann et al.

* cited by examiner

*Primary Examiner* — Robert F Neibaur
(74) *Attorney, Agent, or Firm* — Kelly McGlashen

(57) ABSTRACT

A mandrel assembly may be used with a rotary power tool to provide a reliable and stable connection between the rotary tool and a tool accessory. The mandrel assembly provides a quick-connect/quick-release connection between the tool output shaft and the accessory via a clamping action. In particular, the mandrel assembly is movable between a first configuration in which the accessory may clamped tween a clamping element formed on one end of the mandrel and a collar which surrounds the mandrel and a second configuration in which the accessory may be loaded onto or detached from the mandrel assembly. Movement from the first configuration to the second configuration, and from the second configuration to the first configuration each include axial motion in combination with a rotation of the mandrel in the same direction relative to the collar.

15 Claims, 7 Drawing Sheets

MANDREL ASSEMBLY FOR USE WITH A ROTARY TOOL

BACKGROUND

Hand held rotary tools typically include a tool housing designed to be easily held within a human hand. The housing contains an electric motor which is operable to drive a rotatable chuck of the rotary tool. A mandrel may be releasably coupled to the chuck so as to be rotatably driven by the rotary tool. In turn, an accessory may be releasably secured to the mandrel thereby enabling the rotary tool to rotatably drive the accessory. The accessory may be a cutting blade, a cut-off wheel, a polishing wheel, a grinding wheel, a sanding disc, or any other similar device.

Many types of mechanisms may be used to secure the accessory to the mandrel. In one example, a mandrel includes a base having a threaded aperture and a clamping screw that engages the aperture in order to clamp the accessory between the base and the clamping screw. In this example, a tool is required to tighten the clamping screw. In another example, an accessory is connected to the mandrel via a quick connection clamp that is operated via a lever provided on the tool for that purpose. In this example, the lever mechanism adds weight, complexity and cost to the tool. In both examples, with the accessory so clamped, rotation of the mandrel by the rotary tool causes rotation of the accessory thereby allowing the user to perform work on a workpiece.

Accordingly, it would be advantageous to provide a mandrel that can be used quickly and easily and does not require the use of an additional tool such as a screwdriver, or the use of a relatively small, separate component such as a clamping screw. In addition, it would be advantageous to provide a mandrel having a simple and easily operated mechanism.

SUMMARY

A mandrel assembly is disclosed that may be used with a rotary power tool to provide a reliable and stable connection between the rotary tool and a tool accessory. The mandrel assembly provides a quick-connect/quick-release connection between the tool output shaft and the accessory via a clamping action. In particular, the mandrel assembly is operable to clamp the accessory between a clamping element formed on one end of the mandrel and a collar which surrounds the mandrel and is spring-biased toward the mandrel end.

The mandrel assembly is manually transformable between a first, unlocked configuration in which the accessory can be mounted on the collar or detached from the collar, and a second, locked configuration in which the accessory may be fixed relative to the collar via a clamping force and engagement of the collar with the accessory. The transformation of the mandrel assembly between the first and second configurations is achieved by relative movement of the collar and the mandrel in a predetermined motion. The predetermined motion is set by the shape of slots formed in the mandrel which are engaged by a radially protruding pin of the collar. Movement from the first configuration to the second configuration, and subsequent movement from the second configuration to the first configuration each include axial motion in combination with a rotation of the mandrel in the same direction relative to the collar. This is achieved by providing a slot that encircles a circumference of the mandrel and defines a scalloped path, where the term "scalloped path" refers to a path having a series of serially connected partial-loops. In some embodiments, two partial-loops provide a cycle that corresponds to a 360 degree rotation of the mandrel about its longitudinal axis. In some embodiments, the slot includes four partial-loops which allows completion of two cycles in a 360 degree rotation of the mandrel about its longitudinal axis.

In some aspects, a mandrel assembly includes a mandrel, a collar that surrounds the mandrel, a retention washer and a spring. The mandrel includes a mandrel first end having a mandrel clamping element and a mandrel second end that is opposite the mandrel first end. In addition, the mandrel includes a longitudinal axis that extends through the mandrel first end and the mandrel second end and a slot provided in an outer surface of the mandrel. The collar includes a collar first end, a collar second end that is opposite the first end and a sidewall that extends between the collar first end and the collar second end. The sidewall has an inner surface that defines a bore, the bore opening at the collar first end and the collar second end. The bore has a step change in diameter that defines a collar inner shoulder. The collar includes a pin that protrudes from a surface of the bore and is received in the slot, the pin disposed between the shoulder and the collar first end. The retention washer is fixed to the mandrel between the slot and the mandrel second end. The spring surrounds the mandrel and extends between the retention washer and the collar inner shoulder. The slot is configured to permit the mandrel to move relative to the collar in both rotation about the longitudinal axis and translation along the longitudinal axis.

In some embodiments, the slot encircles a circumference of the mandrel in such a way as to form a continuous and endless path configured to be traveled by the pin.

In some embodiments, the slot includes a first half-cycle portion and a second half-cycle portion that is continuous with the first half-cycle portion. The first half-cycle portion and the second half-cycle portion together form a first cycle that provides a path that when traveled by the pin results in a 360 degree rotation of the mandrel about the longitudinal axis.

In some embodiments, the slot includes a second cycle that is identical to the first cycle and that is continuous with the first cycle. The first cycle and the second cycle together form a continuous and endless path configured to be traveled by the pin.

In some embodiments, the first half-cycle portion and the second half-cycle portion are identical in shape, dimensions and orientation.

In some embodiments, the first half-cycle portion and the second half-cycle portion each include four slot portions. The first slot portion is linear and extends in parallel to the longitudinal axis, the second slot portion is linear and acutely angled relative to the longitudinal axis and the third slot portion is linear and acutely angled relative to the longitudinal axis. The third slot portion is connected to the first slot portion via the second slot portion. The fourth slot portion is continuous with the third slot portion. The fourth slot portion is linear and extends in parallel to the longitudinal axis.

In some embodiments, the movement of the pin in the first slot portion corresponds to a motion of the mandrel relative to the collar in which the mandrel clamping element is translated in a first direction that is parallel to the longitudinal axis such that the clamping element moves away from the collar first end. Movement of the pin in the second slot portion corresponds to a motion of the mandrel relative to the collar in which the mandrel clamping element is translated in the first direction and in which the mandrel rotates about the longitudinal axis. Movement of the pin in the third slot portion corresponds to a motion of the mandrel relative to the collar in which the mandrel clamping element is translated in a second direction that is opposite the first direction and in which the mandrel rotates about the longitudinal axis. In addition, movement of the pin in the fourth slot portion corresponds to a motion of the mandrel relative to the collar in which the mandrel clamping element is translated in the second direction such that the clamping element moves toward the collar first end.

In some embodiments, during movement of the pin the in the second slot portion, the mandrel rotates about the longitudinal axis in a third direction, and during the movement of the pin in the third slot portion, the mandrel rotates about the longitudinal axis in the third direction.

In some embodiments, the first slot portion initiates at the mandrel first end, the fourth slot portion terminates at the mandrel first end, the second and third slot portions are disposed between the mandrel first end and a mandrel shoulder, and the mandrel shoulder is disposed between the mandrel first end and a point of the mandrel that is midway between the mandrel first end and the mandrel second end.

In some embodiments, the fourth slot portion of the first half-cycle portion is coextensive with a portion of the first slot portion of the second half-cycle portion.

In some embodiments, the collar includes posts that protrude from the collar first end in a direction parallel to the longitudinal axis. The collar includes lands disposed between each adjacent pair of posts. Upon an axial relative movement between the collar and the mandrel, the slot is configured to permit the mandrel to move relative to the collar from a first configuration in which the mandrel clamping element is aligned with and abutting end faces of the posts to a second configuration in which the mandrel clamping element is aligned with the lands and urged toward the lands via the spring.

In some embodiments, upon a subsequent axial relative movement between the collar and the mandrel, the slot is configured to permit the mandrel to move relative to the collar from the second configuration to the first configuration.

In some embodiments, during the movement from the first configuration to the second configuration the mandrel rotates about the longitudinal axis in a first direction, and during the movement from the second configuration to the first configuration the mandrel rotates about the longitudinal axis in the first direction.

In some embodiments, the slot encircles a circumference of the mandrel and defines a scalloped path.

In some embodiments, the scalloped path comprises a series of serially connected partial-loops, each partial loop defining a half of a cycle and each half of a cycle including a first slot portion that communicates with a second slot portion via a direction changing third and fourth slot portions.

BRIEF DESCRIPTIONS OF THE DRAWINGS

Figure 14:
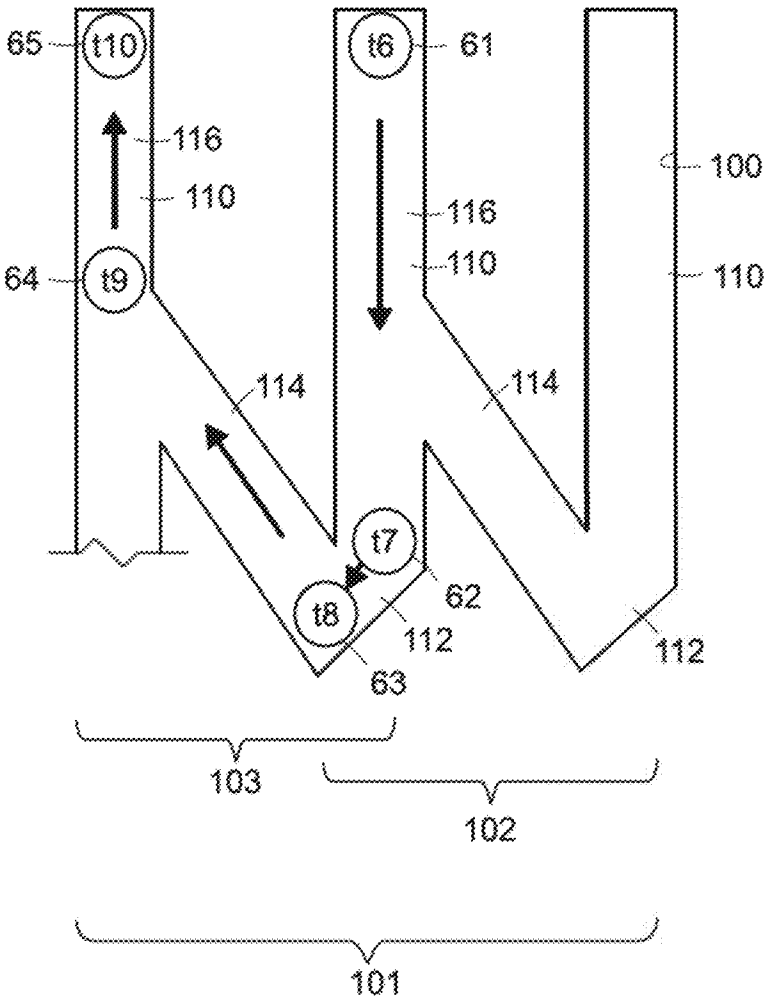
Figure 13:
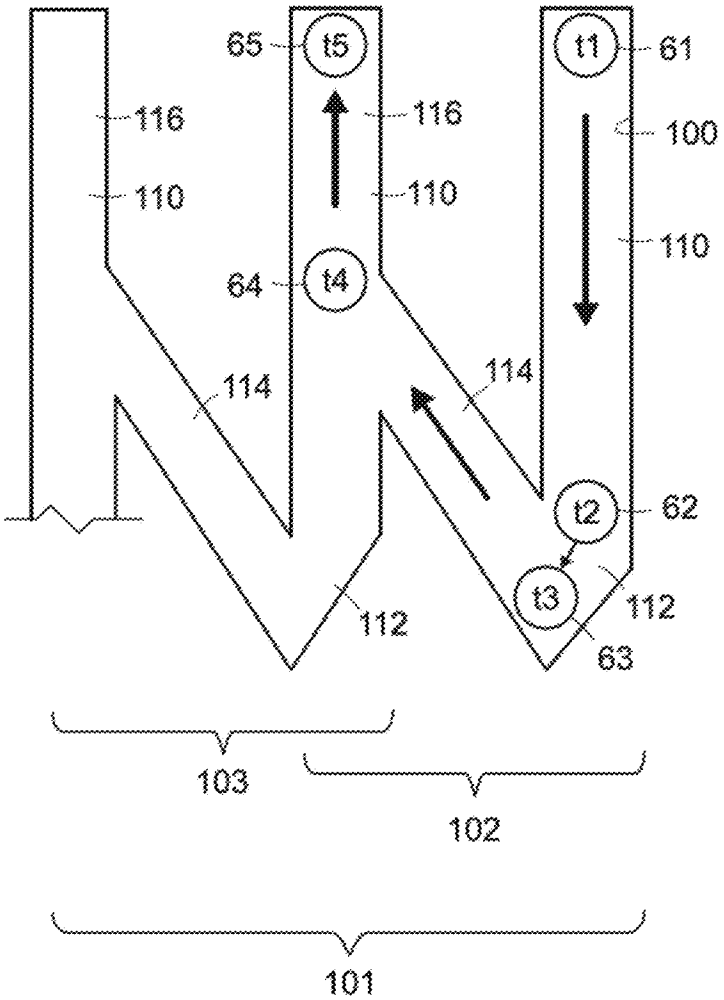

FIGS. 13 and 14 are schematic illustrations of a portion of the mandrel slot corresponding to a single movement cycle, illustrating mandrel locations as represented by open circles and illustrating the time sequence of movement of the pin 30 through the slot as represented by t1, t2, t3, t4, t5 in the first half-cycle portion 102 (FIG. 13) and by t6, t7, t8, t9, t10 in the second half-cycle portion 103 (FIG. 14).

Figure 1:
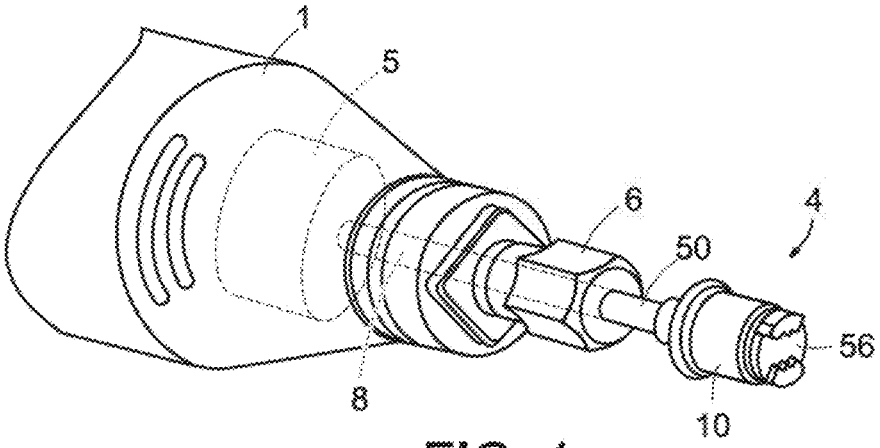
FIG. 1 is a perspective view of a mandrel assembly connected to the chuck of a rotary tool.
Figure 2:
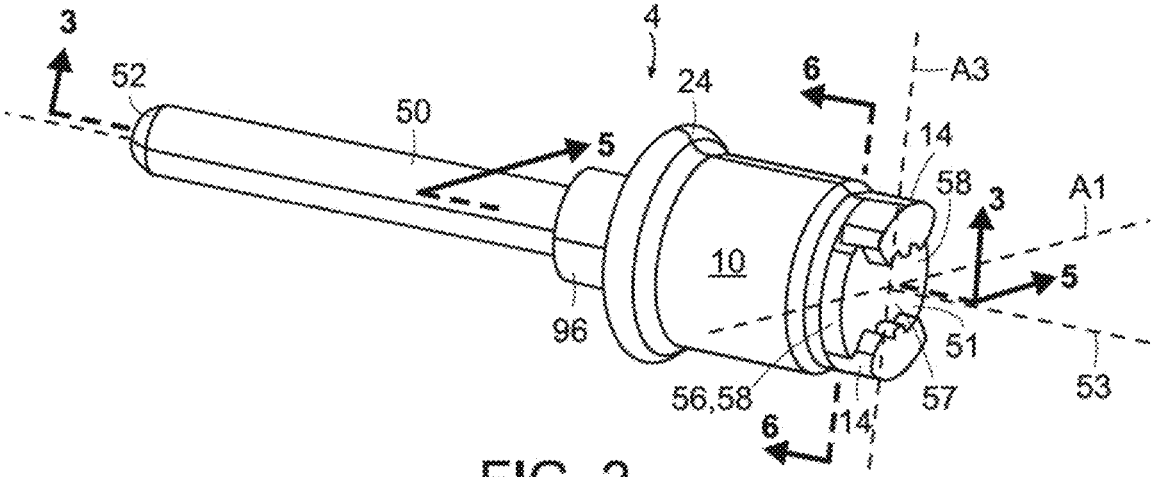
FIG. 2 is a perspective view of the mandrel assembly of FIG. 1.
Figure 15:
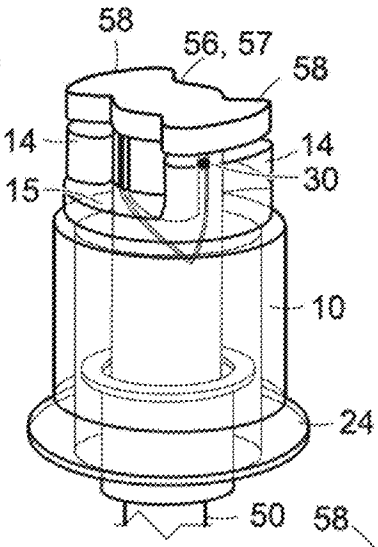

FIG. 15 is a perspective view of the mandrel assembly of FIG. 1 illustrating the pin in the first slot portion and in the first mandrel location whereby the mandrel clamping element is aligned with and abuts the collar posts.

Figure 16:
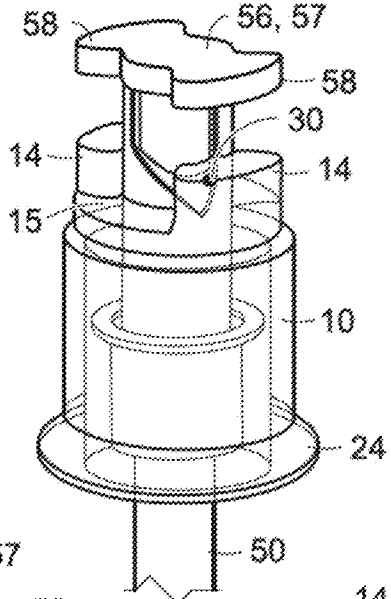

FIG. 16 is a perspective view of the mandrel assembly of FIG. 1 illustrating the pin in the first slot portion and in the second mandrel location and illustrating the mandrel clamping element aligned with the collar posts and spaced apart from the collar posts.

Figure 17:
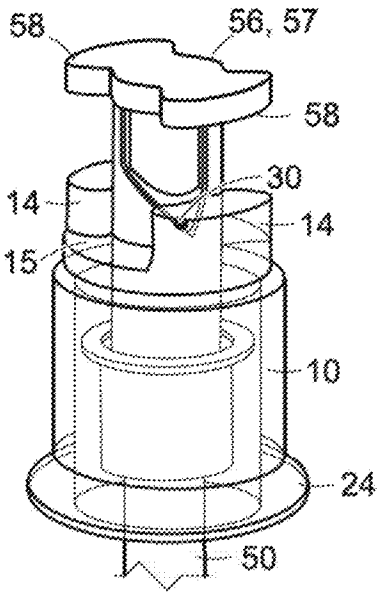

FIG. 17 is a perspective view of the mandrel assembly of FIG. 1 illustrating the pin in the second slot portion and in the third mandrel location and illustrating the mandrel clamping element mis-aligned with the collar posts and at a maximum axial spacing from the collar posts.

Figure 18:
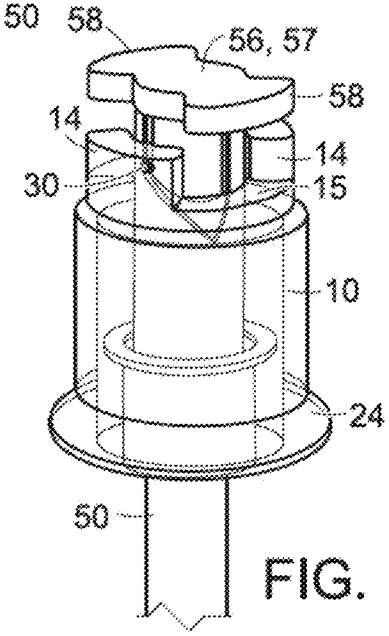

FIG. 18 is a perspective view of the mandrel assembly of FIG. 1 illustrating the pin in the third slot portion and in the fourth mandrel location and illustrating the mandrel clamping element aligned with the collar lands and axially spaced apart from the collar lands.

Figure 19:
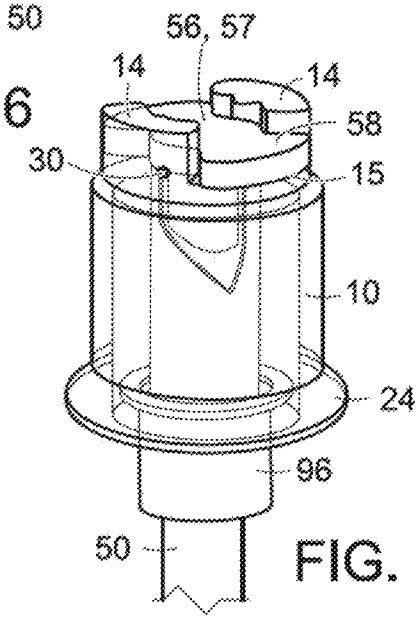

FIG. 19 is a perspective view of the mandrel assembly of FIG. 1 illustrating the pin in the fourth slot portion and in the fifth mandrel location and illustrating the mandrel clamping element aligned with the collar lands and at a close axial spacing from the collar lands whereby the mandrel clamping element is disposed between the posts.

DESCRIPTION

Referring to FIG. 1, a mandrel assembly 4 may be used with a power rotary tool 1 to provide a reliable and stable connection between the rotary tool 1 and a tool accessory 2. The rotary tool 1 includes an electric motor 5. An output shaft 8 of the motor 5 terminates in a chuck 6 configured to be coupled to a mandrel 50 of the mandrel assembly 4. The tool accessory 2 such as a cut-off wheel 200 is configured to be releasably connected to the mandrel assembly 4 via a quick-release clamping action, as discussed in detail below. Operation of the rotary tool 1 rotates the chuck 6, which in turn rotates the mandrel assembly 4, thereby imparting rotary movement to the cut-off wheel 200.

Referring to FIGS. 2-8, the mandrel assembly 4 includes the mandrel 50, a collar 10 having a bore 21 that receives the mandrel 50 therethrough, and a spring 90 that surrounds the mandrel 50 and is disposed in the bore 21. The spring 90 is retained in the bore 21 via a retention washer 80. The mandrel assembly 4 also includes a flat washer 85 disposed between the retention washer 80 and one end 92 of the spring 90, and a spacer 96 disposed on an opposed side of the retention washer 80 relative to the flat washer 86. The constituents of the mandrel assembly 4 will now be described in detail.

The mandrel 50 is a rigid, elongate and generally rod-shaped structure having a first end 51 and a second end 52 that is opposite the first end 51. The mandrel 50 includes a longitudinal axis 53 that extends through the mandrel first and second ends 51, 52 and corresponds to a rotational axis of the mandrel assembly 4. As used herein, the term "axially" refers to the longitudinal axis 53 or a direction parallel to the longitudinal axis 53 and the term "radially" refers to a direction along a radius that is perpendicular to and intersects the longitudinal axis 53.

The mandrel 50 is cylindrical and has a step change in diameter such that the mandrel first end 51 has a greater diameter than the mandrel second end 52. The mandrel 50 includes a mandrel shoulder 59 at the transition between the large diameter portion 54 and the small diameter portion 55. The mandrel shoulder 59 is located between the mandrel first end 51 and a point 60 that is midway between the mandrel first and second ends 51, 52.

The mandrel first end 51 defines a rigid mandrel clamping element 56. The mandrel clamping element 56 is a plate that extends in a plane that is perpendicular to the longitudinal axis 53. The plate has an irregular profile that defines a central circular hub 57 and pair of arms 58 that protrude from opposite sides of the circular hub 57. Each arm 58 has the shape of a circular sector whereby the mandrel clamping element 56 has the appearance of a bow tie when viewed in a direction parallel to the longitudinal axis 53. The hub 57 is centered on the longitudinal axis 53, and the arms 58 are disposed on opposite sides of the hub 57 and are aligned along a first axis A1 that is that is perpendicular to and intersects the longitudinal axis 53. By this configuration, the mandrel 50 has a T-shape when viewed in a side view.

The mandrel second end 52 is configured to be received in the chuck 6 of the rotary tool 1. In the illustrated embodiment, the mandrel second end 52 is rounded to facilitate insertion into the chuck 6.

A slot 100 is provided in the surface of the mandrel large diameter portion 54 so as to be disposed between the mandrel first end 51 and the mandrel shoulder 59. More particularly, the slot 100 is closer to the mandrel first end 51 than the mandrel shoulder 59. In the illustrated embodiment, portions of the slot 100 adjoin the mandrel first end 51. The slot 100 encircles a circumference of the mandrel 50 in such a way as to form a continuous and endless path that is configured to be traveled by the pins 30 of the collar 10, which are described below. To this end, the slot 100 is dimensioned to receive the pins 30 and to permit the pins 30 to translate therein. The slot 100 has an irregular shape that is designed to guide the pins 30 along a predetermined path that results in both translation and rotation of the mandrel 50 with respect to the collar 10 and the longitudinal axis 53. Details of the slot 100 and of the interaction between the pins 30 and the slot 100 are described below.

Referring to FIGS. 3-6 and 9-12, the collar 10 is a hollow, rigid cylinder that surrounds a portion of the mandrel 50. The collar 10 includes a sidewall 19 that extends between a collar first end 11 and a collar second end 12 that is opposite the collar first end 11. An inner surface 20 of the sidewall 19 defines the bore 21. The bore 21 is centered on the longitudinal axis 53 and has a diameter that is greater than that of the mandrel large diameter portion 54, whereby an annular gap 23 exists between the mandrel 50 and the sidewall inner surface 20. The gap 23 is dimensioned to receive the coil spring 90 that is positioned around the mandrel 50 as discussed below.

The collar first end 11 is closed by an end wall 18 except for a centrally-disposed opening 16 through which the mandrel 50 protrudes. The opening 16 is dimensioned to permit the mandrel 50 to rotate and translate freely with respect to the collar 10. An outer surface of the end wall 18 defines a first end surface 18(1) that is perpendicular to the longitudinal axis 53.

The collar 10 includes a pair of pins 30 that extend through the end wall 18 and protrude into the opening 16. The pins 30 are disposed on opposed sides of the opening 16 and are aligned along a second axis A2 that is perpendicular to and intersects the longitudinal axis 53. In other words, the pins 30 protrude radially inward. In the illustrated embodiment, each pin 30 extends through a boss 26 that protrudes radially inward from the opening 16. The pins 30 are shaped and dimensioned to be received in the slot 100 provided in the mandrel large diameter portion 54, as discussed in detail below.

A pair of posts 14 protrude axially outward from the first end surface 18(1). The posts 14 are disposed on opposed sides of the opening 16 so as to be aligned along a third axis A3 that is that is perpendicular to and intersects the longitudinal axis 53. The third axis A3 is parallel to the second axis A2 that extends through the pins 30. By this configuration, each pin 30 is axially aligned with a respective post 14. The posts 14 each have an arc shape when viewed in a direction parallel to the longitudinal axis 53. The portions of the first end surface 18(1) that are disposed between the posts 14 are referred to as lands 15. The lands 15 have the same shape and dimensions as the posts 14 and are axially recessed relative to the respective end faces 14(1) of the posts 14. Like the posts 14, the lands 15 are disposed on opposed sides of the opening 16 so as to be aligned along a fourth axis A4 that is that is perpendicular to and intersects the longitudinal axis 53, where fourth axis A4 is perpendicular to the third axis A3.

An inner surface of the end wall 18 defines a collar inner shoulder 22 that extends between the sidewall inner surface 20 and the central opening 16. The collar inner shoulder 22 faces the collar second end 12 and serves as a seat for a first end 91 of the spring 90.

The collar second end 12 includes an enlarged rim 24 that protrudes radially outward and extends around the circumference of the sidewall 19. The enlarged rim 24 provides a gripping surface that is useful to assist a user in manually gripping the collar 10 and urging the collar 10 to translate axially relative to the mandrel 50, as discussed further below.

Figure 3:
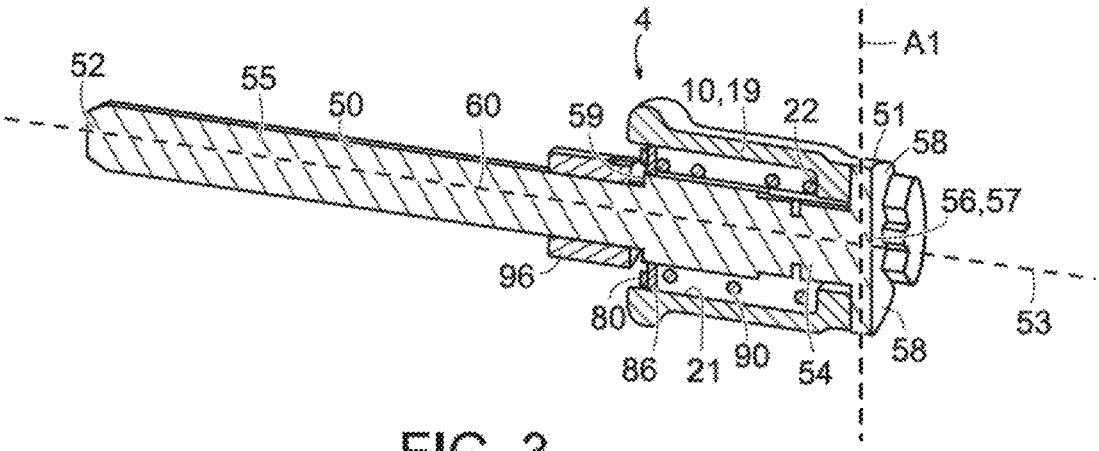
FIG. 3 is a cross-sectional view of the mandrel assembly of FIG. 1 as seen along line 3-3 of FIG. 2.
Figure 4:
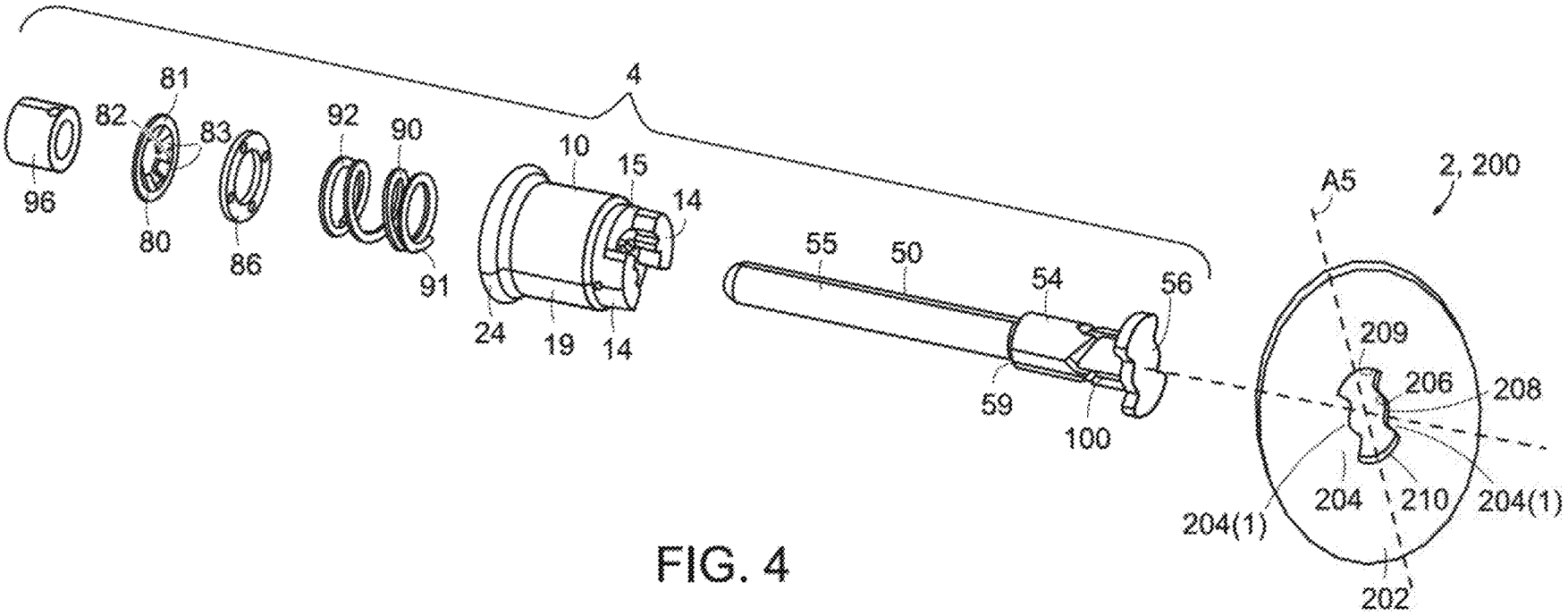
FIG. 4 is an exploded view of the mandrel assembly of FIG. 1 and an accessory.
Figure 5:
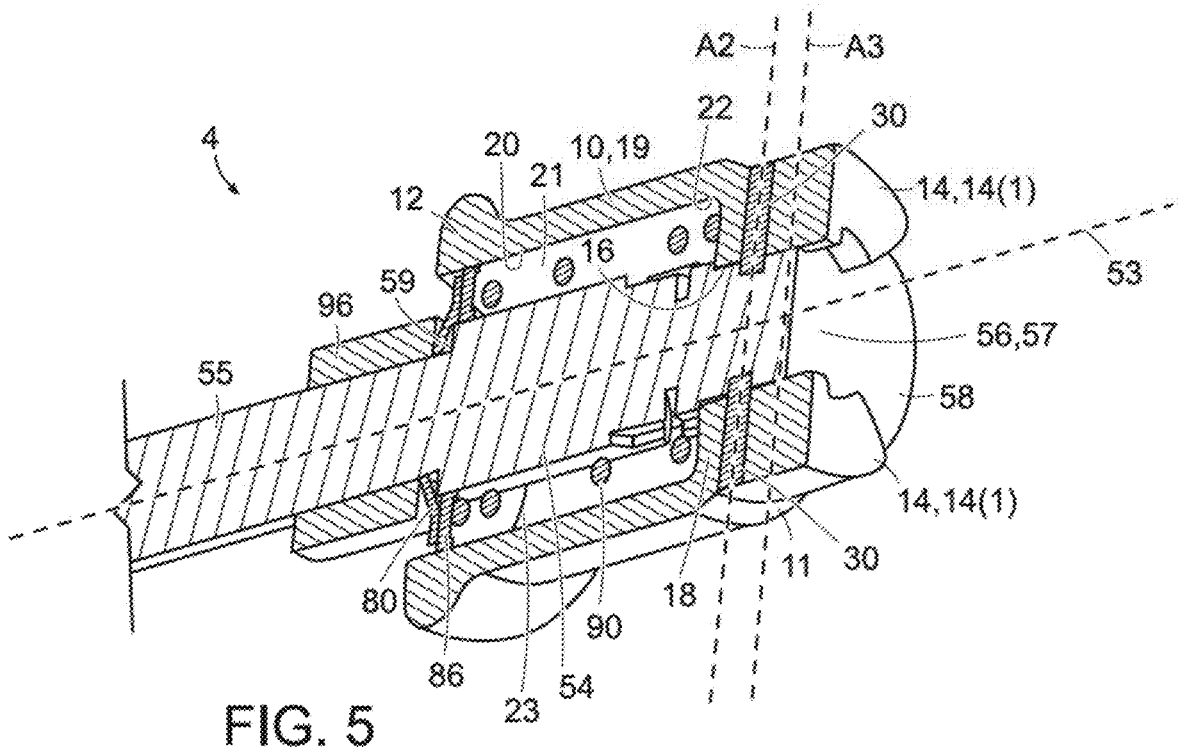
FIG. 5 is a cross-sectional view of the mandrel assembly of FIG. 1 as seen along line 5-5 of FIG. 2.
Figure 6:
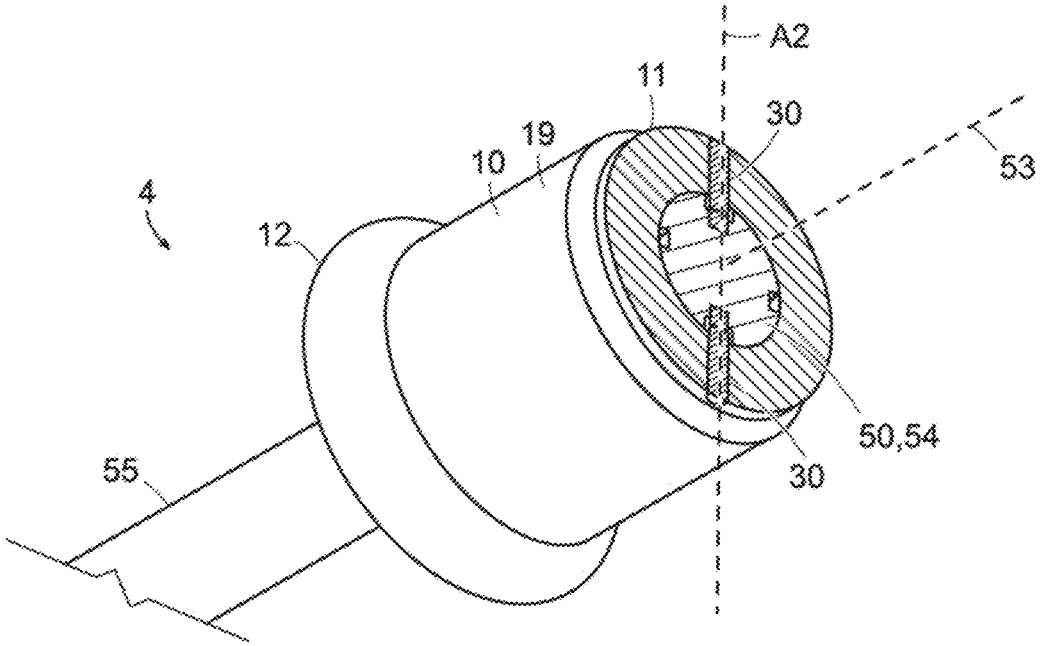
FIG. 6 is a cross-sectional view of the mandrel assembly of FIG. 1 as seen along line 6-6 of FIG. 2.
Figure 7:
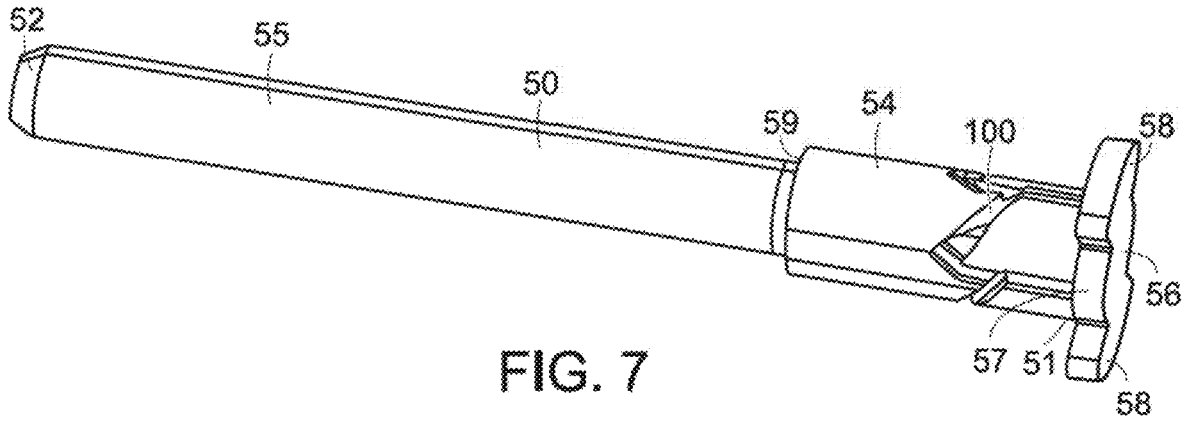
FIG. 7 is a perspective view of the mandrel.
Figure 8:
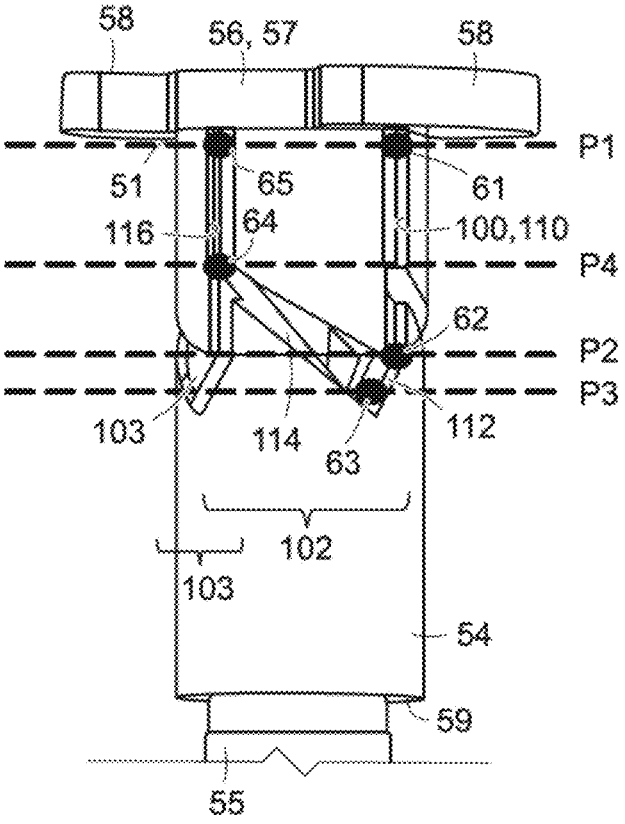
FIG. 8 is a perspective view of an enlarged portion of the mandrel illustrating mandrel locations, represented by filled circles.
Figure 9:
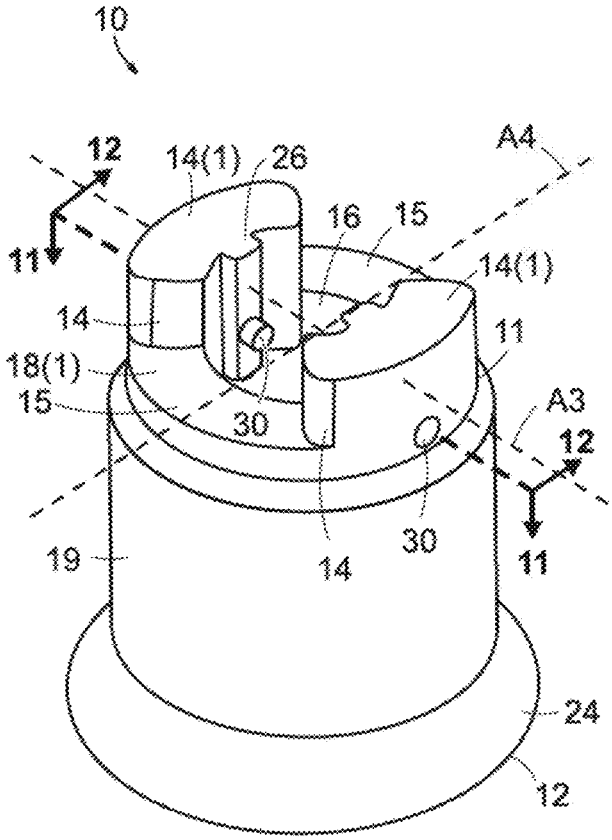
FIG. 9 is a top perspective view of the collar.
Figure 10:
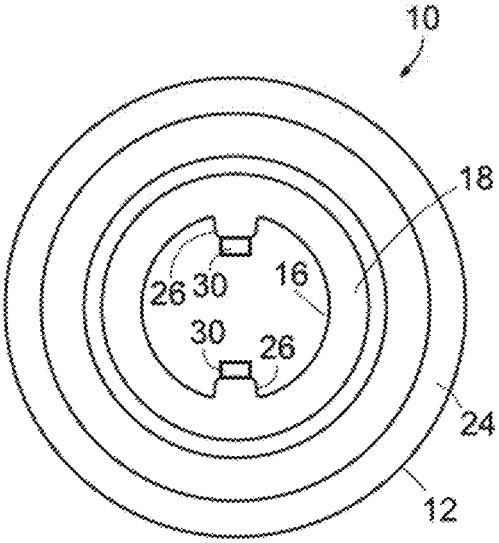
FIG. 10 is a bottom end view of the collar.
Figure 11:
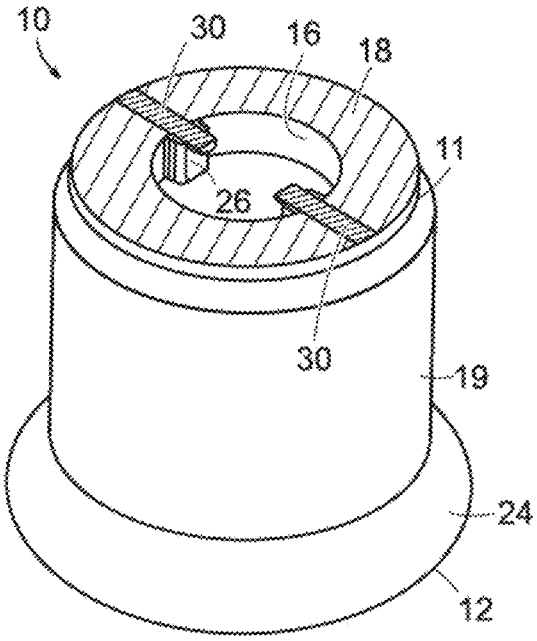
FIG. 11 is a cross-sectional view of the collar as seen along line 11-11 of FIG. 9.
Figure 12:
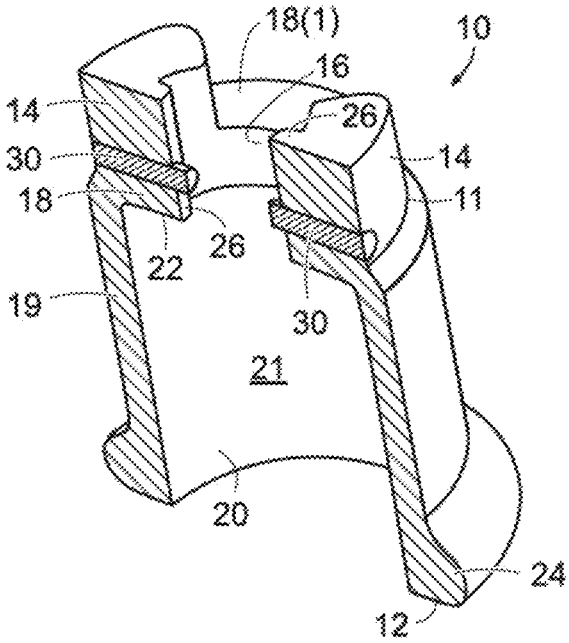
FIG. 12 is a cross-sectional view of the collar as seen along line 12-12 of FIG. 9.

Referring to FIGS. 3-5, the mandrel 50 is retained within the collar 10 via the retention washer 80 that surrounds the mandrel small diameter portion 55 at a location closely adjacent to the mandrel shoulder 59. In the illustrated embodiment, an outer periphery of the retention washer 80 is a flat annulus 81 having an outer diameter than is less than a diameter of the bore 21 and an inner diameter that is less than that of the mandrel small diameter portion 55. An inner periphery 82 of the retention washer includes circumferentially spaced teeth 83. The teeth 83 are angled such that the radially innermost edges of the teeth 83 are non-coplanar with respect to the annulus 81. As a result, the teeth 83 engage an outer surface of the mandrel small diameter portion 55 so as to fix the retention washer 80 relative to the mandrel 50. The retention washer 80 is positioned relative to the mandrel 50 so that the annulus 81 is radially aligned with the mandrel shoulder 59.

In addition to the retention washer 80, the mandrel assembly 4 includes the flat washer 86 having an inner diameter that is greater than the diameter of the mandrel large diameter portion 54 and an outer diameter that is received within the bore 21 with a clearance fit. The flat washer 86 is disposed on the mandrel large diameter portion 54 so as to abut the retention washer annulus 81. In addition, the flat washer 86 is disposed in the bore 21 between the retention washer 80 and collar inner shoulder 22.

The mandrel assembly 4 includes the coil spring 90 that is disposed in the gap 23 between the collar 10 and the mandrel 50. The spring 90 is coaxial with, and surrounds, the mandrel 50. A first end 91 of the spring 90 abuts the collar inner shoulder 22, and the opposite, second end 92 of the spring 90 abuts the flat washer 86, which in turn abuts the retention washer 80. The spring 90 is dimensioned to be under compression in the mandrel assembly 4 so that the spring 90 biases the collar 10 toward the mandrel first end 51.

In addition, the mandrel assembly 4 includes the hollow cylindrical spacer 96 that surrounds the mandrel small diameter portion 55 and is positioned adjacent to the retention washer 80 on a side of the retention washer 80 that is opposite the flat washer 86. The spacer 96 functions to limit depth of insertion of the mandrel 50 into the chuck 6 of the rotary tool 1. In particular, when a user inserts the mandrel second end 52 into the chuck 6, physical interaction between the chuck 6 and the spacer 96 occurs thereby preventing the user from further advancing the mandrel assembly 4 into the chuck 6. The spacer 96 ensures that sufficient space is provided between the chuck 6 and the open second end 12 of the collar 10 when the mandrel assembly 4 is clamped to the chuck 6. Leaving sufficient space between these two components ensures that the collar 10 has enough space for axial travel so as to allow attachment and removal of the accessory 2 to and from the mandrel assembly 4.

Referring again to FIG. 3, the mandrel assembly 4 is operable to quickly and easily attach an accessory 2 to the rotary tool 1. The accessory 2, for example a cut off wheel 200, is secured to the mandrel first end 51 via a clamping action of the mandrel assembly 4. The cut-off wheel 200 includes a rigid hub 204 and a rigid disc portion 202 that surrounds the hub 204. The disc portion 202 defines an outer perimeter of the accessory 2, which in this embodiment provides a cutting surface. A centrally-located hub opening 206 is formed in the hub 204.

In the illustrated embodiment, the hub opening 206 defines a circular central cut out 208, a first cut out 209 disposed on one side of the central cut out 208 and a second cut out 210 disposed on a side of the central cut out 208 opposite the first cut out 209. The first cut out 209 and the second cut out 210 each have the shape of a circular sector whereby the hub opening 206 has the appearance of a bow tie when the accessory 2 is viewed in top plan view. The cut outs 208, 209, 210 are aligned along a fifth axis A5. The central cut out 208 has a diameter that accommodates the hub 57 of the mandrel first end 51 in a tolerance fit, and the first and second cut outs 209, 210 are shaped and dimensioned to receive the collar posts 14 therethrough in a tolerance fit. By this configuration, portions 204(1) of the hub 204 adjacent to the central cut out 208 are axially aligned with and abut the lands 15 of the collar 10 when the accessory 2 is connected to the mandrel assembly 4, as discussed below.

In some embodiments, the cut-off wheel 200 is formed by molding the disc portion 202 from a combination of materials that include abrasive materials, resin materials, and one or more fiberglass mesh segments. Such a molding process is well-known in the art of manufacturing cut-off wheels.

Referring to FIGS. 4-5, 7-8 and 13-14, the mandrel 50 includes the slot 100 that is configured to guide the internal pins 30 of the collar 10 along a predetermined path that results in both translation along the longitudinal axis 53 and rotation about the longitudinal axis 53 of the mandrel 50 with respect to the collar 10.

The slot 100 is dimensioned to receive the pins 30 in a clearance fit. The slot 100 encircles the mandrel large diameter portion 54 and defines a circumferentially-extending scalloped path. The term "scalloped" refers to a path having a series of serially connected partial-loops. In the illustrated embodiment, each partial-loop defines one half of a movement cycle 101. When the pins 30 of the collar 10 move through a movement cycle 101 of the slot 100, the mandrel 50 rotates 360 degrees about the longitudinal axis 53. A movement cycle 101 includes a first half-cycle portion 102 and a second half-cycle portion 103. The first half-cycle portion 102 is also referred to as the lock portion 102, and the second half-cycle portion is also referred to as the unlock portion 103. In the illustrated embodiment, the slot 100 defines two movement cycles 101, or four partial-loops that are connected in series and form a single, continuous path. Within a movement cycle 101, the first half-cycle portion 102 is continuous with and followed by the second half-cycle portion 103. In addition, a portion of the first half-cycle portion 102 is coextensive with a portion of the second half-cycle portion 103 whereby the first and second half-cycle portions are partially overlapping, as discussed further below.

The first half-cycle portion 102 of the slot 100 is identical to the second half-cycle portion 103 of the slot 100 in shape, dimensions and orientation, so only the first half-cycle portion 102 will be described in detail. In the illustrated embodiment, the first half-cycle portion 102 includes four slot portions 110, 112, 114, 116. The slot portions 110, 112, 114, 116 extend between five predetermined locations 61, 62, 63, 64, 65 of the mandrel 50. The mandrel locations 61, 62, 63, 64, 65 are represented by filled circles in FIG. 8 and open circles in FIGS. 13 and 14.

In the first half-cycle portion 102, the first slot portion 110 extends between the first mandrel location 61 and the second mandrel location 62, the second slot portion 112 extends between the second mandrel location 62 and the third mandrel location 63, the third slot portion 114 extends between the third mandrel location 63 and the fourth mandrel location 64 and the fourth slot portion 116 extends between the fourth mandrel location 64 and the fifth mandrel location 65. The first, second, third and fourth slot portions 110, 112, 114, 116 are serially connected such that the pin 30 may travel through the slot 100 between the first mandrel location 61 and the fifth mandrel location 65. By traveling through the slot 100 between the first mandrel location 61 and the fifth mandrel location 65, the pin 30 completes a half-cycle of motion.

The first mandrel location 61 resides in a first plane P1 that is perpendicular to the longitudinal axis 53, and the second mandrel location 62 is disposed in a second plane P2 that is perpendicular to the longitudinal axis 53. The first plane P1 is disposed at, or closely adjacent to, the mandrel first end 51. The second plane P2 is axially spaced apart from the first plane P1 and is disposed between the first plane P1 and the mandrel shoulder 59. The first mandrel location 61 is aligned with the second mandrel location 62 along an axis that is parallel to the longitudinal axis 53. Since the first slot portion 110 extends between the first mandrel location 61 and the second mandrel location 62, the first slot portion 110 is linear and extends in a direction parallel to the longitudinal axis 53.

The third mandrel location 63 resides in a third plane P3 that is perpendicular to the longitudinal axis 53. The third plane P3 is axially spaced apart from the first and second planes P1, P2, and is disposed between the second plane P2 and the mandrel shoulder 59. In addition, when viewed facing the collar first end 11, the third mandrel location 63 is spaced apart from the second mandrel location 62 along a circumference of the collar 10. For example, in some embodiments, the arc length of space between the second mandrel location 62 and the third mandrel location 63 (e.g., the arc length of the second slot portion 42) is in a range of 5 to 15 degrees. For example, in some embodiments, the arc length of space between the second mandrel location 62 and the third mandrel location 63 is 10 degrees. Since the second slot portion 112 extends between the second mandrel location 62 and the third mandrel location 63, the second slot portion 112 is linear and extends in a direction that is acutely angled relative to the longitudinal axis 53.

The fourth mandrel location 64 resides in a fourth plane P4 that is perpendicular to the longitudinal axis 53. The fourth plane P4 is axially spaced apart from the first, second and third planes P1, P2 and P3. The fourth plane P4 is disposed between the first plane P1 and the second plane P2, whereby the fourth mandrel location 64 is closer to the mandrel first end 51 than both the second and third mandrel locations 62, 63. In addition, when viewed facing the collar first end 11, the fourth mandrel location 64 is spaced apart from the third mandrel location 63 along a circumference of the collar 10. For example, in some embodiments, the arc length of space between the third mandrel location 63 and the fourth mandrel location 64 (e.g., the arc length of the third slot portion 114) is in a range of 75 to 85 degrees. For example, in some embodiments, the arc length of space between the third mandrel location 63 and the fourth mandrel location 64, is 80 degrees. Since the third slot portion 114 extends between the third mandrel location 63 and the fourth mandrel location 64, the third slot portion 112 is linear and extends in a direction that is acutely angled relative to the longitudinal axis 53.

The fifth mandrel location 65 resides in the first plane P1 and is aligned with the fourth mandrel location 64 along an axis that is parallel to the longitudinal axis 53. By this configuration, when viewed facing the collar first end 11, the fifth mandrel location 65 is spaced apart from the first mandrel location 61 along a circumference of the collar 10. For example, in some embodiments, the arc length of space between the fifth mandrel location 65 and the first mandrel location 61 (e.g., the sum of the arc lengths of the second and third slot portions 112, 114) is 90 degrees. Since the fourth slot portion 116 extends between the fourth mandrel location 64 and the fifth mandrel location 65, the fourth slot portion 116 is linear and extends in a direction parallel to the longitudinal axis 53.

In the slot 100, the first and fourth slot portions 110, 116 are parallel to each other and offset along the circumference of the mandrel 50. In addition, the length of the first slot portion 110 (e.g., the distance between the first and second mandrel locations 61, 62) is greater than that of the fourth slot portion 116 (e.g., the distance between the fourth and fifth mandrel locations 64, 65). For example, in the illustrated embodiment, the length of the fourth slot portion 116 is about two-thirds the length of the first slot portion 110.

The second and third slot portions 112, 114 intersect to form a V or U shape that directs the pin 30 to reverse direction of relative axial motion between the mandrel 50 and the collar 10. In addition, the length of the third slot portion 114 (e.g., the distance between the third and fourth mandrel locations 63, 64) is greater than the length of the second slot portion 112 (e.g., the distance between the second and third mandrel locations 62, 63). For example, in the illustrated embodiment, the length of the third slot portion 114 is about three times the length of the second slot portion 112.

The fourth slot portion 116 of the first half-cycle portion 102 is coextensive with a portion of the first slot portion 110 of the second half-cycle portion 103 that is closest to the mandrel first end 51 and the mandrel clamping element 56.

Referring to FIGS. 13-19, the mandrel assembly 4 is manually transformable between a first, unlocked configuration (FIG. 15) and a second, unlocked configuration (FIG. 19). The mandrel assembly 4 is transformed from the first configuration to the second configuration by relative movement between the mandrel 50 and the collar 10 which is directed by movement of the pins 30 within the first half-cycle 102. The mandrel assembly 4 is transformed from the second configuration to the first configuration by relative movement between the mandrel 50 and the collar 10 which is directed by movement of the pins 30 within the second half-cycle 103. When transforming between the first configuration and the second configuration, the slot 100 guides the pins 30 along a predetermined path that results in both translation and rotation of the mandrel 50 with respect to the collar 10.

A movement cycle 101 of the pins 30 through the slot 100 is illustrated schematically in FIGS. 13 and 14. FIG. 13 shows a pin 30 positioned in the respective mandrel locations 61, 62, 63, 64, 65 through a time sequence t1, t2, t3, t4, t5 corresponding to the first half-cycle portion 102, and FIG. 14 shows a pin 30 positioned in the respective mandrel locations 61, 62, 63, 64, 65 through a time sequence t6, t7, t8, t9, t10 corresponding to the adjacent second half-cycle portion 103. In addition, the relative positions of the mandrel 50 with respect to the collar 10 are illustrated in FIGS. 15-19 for pins 30 positioned in each of the respective mandrel locations 61, 62, 63, 64, 65, as will now be described.

Referring to FIGS. 13 and 15, at the beginning of a movement cycle 101 (e.g., at time t1), the mandrel assembly 4 may be in the first configuration. In the first configuration, the pins 30 are disposed in the first mandrel location 61 of the first slot portion 110 of a first half-cycle portion 102. When the pins 30 are disposed in the first mandrel location 61, the mandrel clamping element 56 is disposed at the collar first end 11. In particular, the first axis A1 is aligned with the third axis A3, whereby the arms 58 of the mandrel clamping element 56 are aligned with the posts 14. The first mandrel location 61 is positioned so that the arms 58 abut the respective end faces 14(1) of the posts 14. In this configuration, the post end faces 14(1) are urged against the arms 58 by the coil spring 90. Because the arms 58 are aligned with and resting on the posts 14, the mandrel clamping element 56 and the posts 14 can be inserted into the hub opening 206 of the accessory 2. This configuration is referred to as the unlocked configuration since the accessory 2 can be mounted on the collar 10 or removed from the collar 10 while the arms 58 of the mandrel clamping element 56 are aligned with the posts 14.

Referring to FIGS. 13 and 16, a user may initiate the transformation between the first and second configurations by manually moving the collar 10 toward the mandrel second end 52. As a result, the pins 30 move axially along the first slot portion 110 from the first mandrel location 61 to the second mandrel location 62 (e.g., corresponding to time t2). During movement between the first and second mandrel locations 61, 62, the mandrel 50 moves axially relative to the collar 10 without rotation such that the mandrel clamping element 56 moves away from the posts 14 while the first and third axes A1, A3 remain in axial alignment.

Referring to FIGS. 13 and 17, when the pins 30 are in the second mandrel location 62, the user continues to move the collar 10 toward the mandrel second end 52 and the pins 30 move through the second slot portion 112 of the first half-cycle portion 102 to the third mandrel location 63 (e.g., corresponding to time t3). During movement between the second and third mandrel locations 62, 63, the mandrel 50 continues to move axially relative to the collar 10 such that the mandrel clamping element 56 moves still further away from the posts 14. In addition, the circumferential movement of the pins 30 causes the mandrel 50 to rotate relative to the collar 10. As previously discussed, the second slot portion 112 may permit a rotation in a range of five degrees to fifteen degrees.

The third mandrel location 63 represents a vertex of the first half-cycle portion 102 corresponding to a location at which the slot 100 reverses axial direction. When the pins 30 are in the third mandrel location 63, the axial force of the spring 90 urges the collar 10 toward the mandrel first end 51. As a result, the user is not required to apply a manual force to the collar to complete the first half-cycle portion 102.

Referring to FIGS. 13 and 18, as the pins move along the third slot portion 114 of the first half-cycle portion 102 to the fourth mandrel location 64 (e.g., corresponding to time t4), rotational momentum urges the collar 10 to continue rotation relative to the mandrel 50. As a result, the mandrel 50 rotates about the longitudinal axis 53 while moving axially. As previously discussed, the third slot portion 114 may permit a rotation in a range of 75 degrees to 85 degrees. As a result, the first axis A1 rotates into alignment with the fourth axis A4, and the spacing between the mandrel clamping element 56 and the collar first end 11 is decreased.

Referring to FIGS. 13 and 19, as the pins 30 move from the fourth mandrel location 64 to the fifth mandrel location 65 (e.g., corresponding to time t5), the mandrel 50 moves axially along the fourth slot portion 116 of the first half-cycle portion 102 under the axial force of the coil spring 90 until the pins 30 rest in the mandrel fifth location 65. This configuration corresponds to the second configuration of the mandrel assembly 4. In the second configuration, the first axis A1 is aligned with the fourth axis A4 such that the arms 58 of the mandrel clamping element 56 are aligned with the lands 15 and are urged toward the lands 15 due to the force of the spring 90 on the collar 10.

In the transformation from the first configuration as shown in FIG. 15 to the second configuration as shown in FIG. 19, the pins 30 have passed through the first half-cycle portion 102 of the movement cycle 101. During the first half-cycle portion 102, the mandrel clamping element 56 has lifted off the posts 14, rotated 90 degrees about the longitudinal axis 53, and then has been lowered to, and urged against, the lands 15.

When the mandrel assembly 4 is in the second configuration, an accessory 2 that is mounted on the collar 10 (not shown in FIG. 19) may be fixed relative to the collar first end 11 by clamping the accessory 2 between the collar first end surface 18(1) and the mandrel clamping element 56. In this configuration, the accessory 2 is prevented from relative rotation with respect to the collar 10 via engagement between the hub opening 206 of the accessory 2 and the posts 14 of the collar 10.

To release the clamped accessory 2, the collar 10 is transformed from the second configuration to the first configuration by moving the pins 30 along the second half-cycle portion 103. In the second half-cycle portion 103, the mandrel 50 continues to rotate in the same direction as was rotated in the first half-cycle portion 102. For example, if the mandrel 50 rotated in a clockwise direction during the first half-cycle portion 102 as viewed facing the mandrel first end 51, the mandrel 50 continues to rotate in the clockwise direction during the second half-cycle portion 103.

Referring to FIG. 14, when transforming from the second, locked configuration to the first, unlocked configuration, the pins 30 move through the second half-cycle portion 103 of the movement cycle 101. At the beginning of the second half-cycle portion 103 (e.g., at time t6), the pins 30 are disposed in the first mandrel location 61 of the first slot portion 110 of the second half-cycle portion 103. When the pins 30 are disposed in the first mandrel location 61, the mandrel clamping element 56 is disposed at the collar first end 11. In particular, the first axis A1 is aligned with the fourth axis A4, whereby the arms 58 of the mandrel clamping element 56 are aligned with the lands 15. The first mandrel location 61 is positioned so that the arms 58 abut the respective lands 15 absent an intervening accessory 2.

A user may initiate the transformation from the second configuration to the first configuration by manually moving the collar 10 toward the mandrel second end 52. As a result, the pins 30 move axially along the first slot portion 110 from the first mandrel location 61 to the second mandrel location 62 (e.g., corresponding to time t7). During movement between the first and second mandrel locations 61, 62, the mandrel 50 moves axially relative to the collar 10 without rotation such that the mandrel clamping element 56 moves away from the lands 15 while the first and fourth axes A1, A4 remain in axial alignment.

When the pins 30 are in the second mandrel location 62, the user continues to move the collar 10 toward the mandrel second end 52 and the pins 30 move through the second slot portion 112 of the second half-cycle portion 103 to the third mandrel location 63 (e.g., corresponding to time t8). During movement between the second and third mandrel locations 62, 63, the mandrel 50 continues to move axially relative to the collar 10 such that the mandrel clamping element 56 moves still further away from the land 15. In addition, the circumferential movement of the pins 30 causes the mandrel 50 to rotate relative to the collar 10. As previously discussed, the second slot portion 112 may permit a rotation in a range of five degrees to fifteen degrees.

The third mandrel location 63 represents a vertex of the second half-cycle portion 103 corresponding to a location at which the slot 100 reverses axial direction. When the pins 30 are in the third mandrel location 63, the axial force of the spring 90 urges the collar 10 toward the mandrel first end 51. As a result, the user is not required to apply a manual force to the collar 10 to complete the second half-cycle portion 103.

As the pins move along the third slot portion 114 of the second half-cycle portion 103 to the fourth mandrel location 64 (e.g., corresponding to time t9), rotational momentum urges the collar 10 to continue rotation relative to the mandrel 50. As a result, the mandrel 50 rotates about the longitudinal axis 53 while moving axially. As previously discussed, the third slot portion 114 may permit a rotation in a range of 75 degrees to 85 degrees. As a result, the first axis A1 rotates into alignment with the third axis A3, and the spacing between the mandrel clamping element 56 and the collar first end 11 is decreased.

As the pins 30 move from the fourth mandrel location 64 to the fifth mandrel location 65 (e.g., corresponding to time t10), the mandrel 50 moves axially along the fourth slot portion 116 of the second half-cycle portion 103 under the axial force of the coil spring 90 until the pins 30 rest in the mandrel fifth location 65. This configuration corresponds to the first configuration of the mandrel assembly 4. In the first configuration, the first axis A1 is aligned with the third axis A3 such that the arms 58 of the mandrel clamping element 56 are aligned with the posts 14 and are urged toward the posts 14 due to the force of the spring 90 on the collar 10.

In the transformation from the second configuration as shown in FIG. 19 to the first configuration as shown in FIG. 15, the pins 30 have passed through the second half-cycle portion 103 of the movement cycle 101. During the second half-cycle portion 103, the mandrel clamping element 56 has lifted off the lands 15, rotated 90 degrees about the longitudinal axis 53, and then has been lowered to, and urged against, the posts 14.

As described above, a mandrel assembly 4 is disclosed that allows an accessory 2 to be quickly and conveniently coupled to and/or decoupled from the mandrel assembly 4 without the need for an additional tool such as a screw driver. Therefore, the mandrel assembly 4 may be conveniently used to connect numerous interchangeable accessories such as cut-off wheels, polishing wheels, grinding wheels, sanding discs, or similar articles of manufacture to the power tool 1.

In the illustrated embodiment, both the mandrel 50 and the collar 10 are formed of metal such as steel. However, depending on the requirements of the specific application, the mandrel 50 may be formed of a different material than the collar 10. In some embodiments, the mandrel 50 and the collar 10 may be formed of alternative materials such as high strength polymers as determined by the requirements of the application.

In the illustrated embodiment, the mandrel 50 includes the slot 100 that is considered provides two cycles of relative motion between the mandrel 50 and the collar 10. The slot 100 is not limited to this configuration. For example, in some embodiments, the slot 100 includes a single movement cycle 101. In other embodiments, the slot 100 includes three or more movement cycles 101.

In the illustrated embodiment, the collar 10 includes a pair of pins 30. The collar 10 is not limited to having two pins. For example, in some embodiments, the collar 10 includes a single pin 30. In other embodiments, the collar 10 includes multiple pairs of pins 30, e.g., four or more pins 30.

In the illustrated embodiment, the mandrel 50 includes the slot 100 in which each of the slot portions 110, 112, 114, 116 is linear. The slot 100 is not limited to this configuration. For example, the slot portions that result in rotational motion of the mandrel 50 may be arcuate rather than linear. Thus, in some embodiments, the second and third slot portions 112, 114 may be curved.

In the illustrated embodiment, the slot portions that define the first half-cycle portion 102 and the second half-cycle portion 103 are identical. The slot 100 is not limited to this configuration. For example, in some embodiments, the shape and dimensions of the portion of the slot 100 that provides the first half-cycle portion 102 may be slightly different than the those of the portion of the slot 100 that provides the second half-cycle portion 103.

Selective illustrative embodiments of mandrel assembly for a power tool are described above in some detail. It should be understood that only structures considered necessary for clarifying the mandrel assembly have been described herein. Other conventional structures, and those of ancillary and auxiliary components of the mandrel assembly, power tool and accessory are assumed to be known and understood by those skilled in the art. Moreover, while working examples of the mandrel assembly have been described above, the mandrel assemblies are not limited to the working examples described above, but various design alterations may be carried out without departing from the device as set forth in the claims.

What is claimed is:

1. A mandrel assembly, comprising:

a mandrel including a mandrel first end having a mandrel clamping element, a mandrel second end that is opposite the mandrel first end, a longitudinal axis that extends through the mandrel first end and the mandrel second end, and a slot provided in an outer surface of the mandrel;

a collar that surrounds the mandrel, the collar including a collar first end, a collar second end that is opposite the first end, and a sidewall that extends between the collar first end and the collar second end, the sidewall including an inner surface that defines a bore, the bore opening at the collar first end and the collar second end, the bore having a step change in diameter that defines a collar inner shoulder, and a pin that protrudes from a surface of the bore and is received in the slot, the pin disposed between the shoulder and the collar first end;

a retention washer fixed to the mandrel between the slot and the mandrel second end; and a spring that surrounds the mandrel, the spring extending between the retention washer and the collar inner shoulder, wherein the slot is configured to permit the mandrel to move relative to the collar in both rotation about the longitudinal axis and translation along the longitudinal axis.

2. The mandrel assembly of claim 1, wherein the slot encircles a circumference of the mandrel in such a way as to form a continuous and endless path configured to be traveled by the pin.

3. The mandrel assembly of claim 1, wherein the slot includes a first half-cycle portion, and a second half-cycle portion that is continuous with the first half-cycle portion, wherein the first half-cycle portion and the second half-cycle portion together form a first cycle that provides a path that when traveled by the pin results in a 360 degree rotation of the mandrel about the longitudinal axis.

4. The mandrel assembly of claim 3, wherein the slot includes a second cycle that is identical to the first cycle and that is continuous with the first cycle, the first cycle and the second cycle together forming a continuous and endless path configured to be traveled by the pin.

5. The mandrel assembly of claim 3, wherein the first half-cycle portion and the second half-cycle portion are identical in shape, dimensions and orientation.

6. The mandrel assembly of claim 3, wherein the first half-cycle portion and the second half-cycle portion each include a first slot portion that is linear and extends in parallel to the longitudinal axis, a second slot portion that is linear and acutely angled relative to the longitudinal axis, a third slot portion that is linear and acutely angled relative to the longitudinal axis, the third slot portion being connected to the first slot portion via the second slot portion, and a fourth slot portion that is continuous with the third slot portion, the fourth slot portion being linear and extending in parallel to the longitudinal axis.

7. The mandrel assembly of claim 6, wherein movement of the pin in the first slot portion corresponds to a motion of the mandrel relative to the collar in which the mandrel clamping element is translated in a first direction that is parallel to the longitudinal axis such that the clamping element moves away from the collar first end, movement of the pin in the second slot portion corresponds to a motion of the mandrel relative to the collar in which the mandrel clamping element is translated in the first direction and in which the mandrel rotates about the longitudinal axis, movement of the pin in the third slot portion corresponds to a motion of the mandrel relative to the collar in which the mandrel clamping element is translated in a second direction that is opposite the first direction and in which the mandrel rotates about the longitudinal axis, and movement of the pin in the fourth slot portion corresponds to a motion of the mandrel relative to the collar in which the mandrel clamping element is translated in the second direction such that the clamping element moves toward the collar first end.

8. The mandrel assembly of claim 7, wherein during movement of the pin the in the second slot portion, the mandrel rotates about the longitudinal axis in a third direction, and during the movement of the pin in the third slot portion, the mandrel rotates about the longitudinal axis in the third direction.

9. The mandrel assembly of claim 6, wherein the first slot portion initiates at the mandrel first end, the fourth slot portion terminates at the mandrel first end, the second and third slot portions are disposed between the mandrel first end and a mandrel shoulder, and the mandrel shoulder is disposed between the mandrel first end and a point of the mandrel that is midway between the mandrel first end and the mandrel second end.

10. The mandrel assembly of claim 6, wherein the fourth slot portion of the first half-cycle portion is coextensive with a portion of the first slot portion of the second half-cycle portion.

11. The mandrel assembly of claim 1, wherein the collar includes posts that protrude from the collar first end in a direction parallel to the longitudinal axis, the collar includes lands disposed between each adjacent pair of posts, upon an axial relative movement between the collar and the mandrel, the slot is configured to permit the mandrel to move relative to the collar from a first configuration in which the mandrel clamping element is aligned with and abutting end faces of the posts, to a second configuration in which the mandrel clamping element is aligned with the lands and urged toward the lands via the spring.

12. The mandrel assembly of claim 11, wherein upon a subsequent axial relative movement between the collar and the mandrel, the slot is configured to permit the mandrel to move relative to the collar from the second configuration to the first configuration.

13. The mandrel assembly of claim 12, wherein during the movement from the first configuration to the second configuration the mandrel rotates about the longitudinal axis in a first direction, and during the movement from the second configuration to the first configuration the mandrel rotates about the longitudinal axis in the first direction.

14. The mandrel assembly of claim 1, wherein the slot encircles a circumference of the mandrel and defines a scalloped path.

15. The mandrel assembly of claim 14, wherein the scalloped path comprises a series of serially connected partial-loops, each partial loop defining a half of a cycle and each half of a cycle including a first slot portion that communicates with a second slot portion via a direction changing third and fourth slot portions.

* * * * *